US005108643A

United States Patent [19]

Loth et al.

[11] Patent Number: 5,108,643

[45] Date of Patent: * Apr. 28, 1992

[54] STABLE MICROEMULSION CLEANING COMPOSITION

[75] Inventors: Myriam Loth, Saint Nicolas; Claude Blanvalet, Angleur; Baudouin Valange, Gembloux, all of Belgium

[73] Assignee: Colgate-Palmolive Company, Piscataway, N.J.

[ * ] Notice: The portion of the term of this patent subsequent to Dec. 24, 2008 has been disclaimed.

[21] Appl. No.: 267,872

[22] Filed: Nov. 7, 1988

Related U.S. Application Data

[63] Continuation-in-part of Ser. No. 120,250, Nov. 12, 1987, which is a continuation-in-part of Ser. No. 85,902, Aug. 14, 1987, which is a continuation-in-part of Ser. No. 866,029, May 21, 1986.

[51] Int. Cl.[5] ..... C11D 11/00

[52] U.S. Cl. ..... 252/174.11; 252/174.16; 252/174.21; 252/174.19; 252/170; 252/171

[58] Field of Search ..... 252/122, 174.11, 174.16, 252/174.21, 170, 171, 162, 174.19, 162

[56] References Cited

U.S. PATENT DOCUMENTS 4,511,488 4/1985 Matta ..... 252/162

FOREIGN PATENT DOCUMENTS 0040882 12/1981 European Pat. Off. .
0316726 5/1989 European Pat. Off. .
2144763 3/1985 United Kingdom .
2190681 11/1987 United Kingdom .

OTHER PUBLICATIONS

Chemical Abstracts, vol. 105 (1986), No. 8, at page 128 (designator 105:62775b), reporting on Japanese Patent 61012798.

*Primary Examiner*—Josephine Barr
*Attorney, Agent, or Firm*—Bernard Lieberman; Robert C. Sullivan; Murray M. Grill

[57] ABSTRACT

Stable microemulsion cleaning compositions are described which, in the absence of opacifying component, appear clear to the eye, and which are especialy useful for cleaning surfaces having oily or greasy soils thereon, which comprise synthetic organic detergent, water, co-surfactant of a described type, and perfume (or equivalent hydrocarbon). The detergent composition may be concentrated and may be employed as is, or it may be in dilution with water, in the form of a similarly clear and stable microemulsion. In process aspects of the invention both the concentrated and the diluted compositions may be employed to remove oily and greasy stains from substrates, such as normally shiny bathroom fixture and floor and wall surfaces, including tiles, by a "spray and wipe" process, which leaves the surface shiny, with minimal or no rinsing needed. When the invented compositions are acidic they are also useful for removing lime scale and soap scum from hard surfaces. Also described are processes for manufacturing the invented compositions.

21 Claims, No Drawings

STABLE MICROEMULSION CLEANING COMPOSITION

This application is a continuation-in-part of U.S. patent application Ser. No. 07,120,250, filed Nov. 12, 1987, which is a continuation-in-part of Ser. No. 07,085,902, filed Aug. 14, 1987, which is a continuation-in-part of U.S. Ser. No. 06,066,029, filed May 21, 1986 all pending. The disclosures of such applications are hereby incorporated by reference.

This invention relates to a stable microemulsion cleaning composition and to processes for manufacture and use thereof. More particularly, it relates to a stable aqueous microemulsion cleaning composition in concentrated or diluted form which, in the absence of any opacifying component, is clear, and which is especially effective to clean oily and greasy soils from substrates, such as bathroom fixtures and walls, leaving such surfaces clean and shiny without the need for extensive rinsing thereof. The described compositions comprise a synthetic organic detergent, an essentially water insoluble perfume (which may omit terpenes), water and a suitable co-surfactant, which co-surfactant, adjusts the interface conformation to reduce interfacial tension at interfaces between dispersed and continuous phases of the emulsion of the detergent, perfume and water, produces a stable, normally clear microemulsion, at room temperature. When the pH of the microemulsion is on the acid side, preferably in the range of 1 to 4, the invented compositions are useful for removing lime scale and soap scum from hard substrates.

Liquid detergent compositions, usually in solution or emulsion form, have been employed as all-purpose detergents and have been suggested for cleaning hard surfaces, such as painted woodwork, bathtubs, sinks, tile floors, tiled walls, linoleum, paneling and washable wallpaper. Many such preparations, such as those described in U.S. Pat. Nos. 2,560,839, 3,234,138, and 3,350,319, and British patent specification No. 1223739, include substantial proportions of inorganic phosphate builder salts, the presences of which can sometimes be found objectionable for environmental reasons and also because they necessitate thorough rinsing of the liquid detergent from the cleaned surface to avoid the presence of noticeable depositings of phosphate thereon. In U.S. Pat. Nos. 4,017,409 and 4,244,840 liquid detergents of reduced phosphate builder salt contents have been described but such may still require rinsing or can include enough phosphate to be environmentally objectionable. Some liquid detergents have been made which are phosphate-free, such as those described in U.S. Pat. No. 3,935,130, but these normally include higher percentages of synthetic organic detergent, which increased detergent content may be objectionable due to excessive foaming during use that can result from its presence. The previously described liquid detergent compositions are emulsions but are not disclosed to be microemulsions like those of the present invention.

Microemulsions have been disclosed in various patents and patent applications for liquid detergent compositions which may be useful as hard surface cleaners or all-purpose cleaners, and such compositions have sometimes included detergent, solvent, water and a co-surfactant. Among such disclosures are European patent specifications No's. 0137615, 0137616, and 0160762, and U.S. Pat. No. 4,561,991, all of which describe employing at least 5% by weight of the solvent in the compositions. The use of magnesium salts to improve grease removing performance of solvents in microemulsion liquid detergent compositions is mentioned in British patent specification No. 2144763. Other patents on liquid detergent cleaning compositions in microemulsion form are U.S. Pat. Nos. 3,723,330, 4,472,291, and 4,540,448. Additional formulas of liquid detergent compositions in emulsion form which include hydrocarbons, such as terpenes, are disclosed in British patent specifications 1603047 and 2033421, European specification No. 0080749; and U.S. Pat. Nos. 4,017,409, 4,414,128, and 4,540,505. However, the presence of builder salt in such compositions, especially in the presence of magnesium compounds, tends to destabilize the microemulsions and therefore such builders are considered to be undesirable.

Although the cited prior art relates to liquid all-purpose detergent compositions in emulsion form and although various components of the present compositions are mentioned in the art, it is considered that the art does not anticipate or make obvious subject matter disclosed and claimed herein. In accordance with the present invention a stable aqueous microemulsion cleaning composition, which may be in concentrated or dilute form, comprises anionic synthetic organic detergent and/or nonionic synthetic organic detergent, essentially water insoluble perfume, water and co-surfactant, which co-surfactant adjusts interfacial conformation to reduce interfacial tension at interfaces between dispersed and continuous phases of an emulsion of said detergent, perfume and water, and produces a stable concentrated microemulsion which, in the absence of opacifying component, is clear and stable at temperatures in the range of 5° to 50° C., and which is at a pH in the range of 1 to 11. Such concentrated microemulsion appears clear, in the absence of any opacifying agent in the composition, and is dilutable with water to at least five times its weight, to produce a diluted liquid detergent composition which is often also a stable aqueous microemulsion which, in the absence of opacifying agent, is also clear, and which is useful as an all-purpose cleaning composition. Both the concentrated and diluted compositions are effective for cleaning oily and greasy soils from substrates, and when the compositions are acidic they are also useful to remove lime scale and soap scum from hard surfaces, such as bathroom fixtures, floors and walls.

In addition to microemulsion concentrates, the present invention also relates to dilute microemulsions, to processes for manufacturing such microemulsions and to processes for cleaning surfaces with them.

The present invention provides an improved, clear, liquid cleaning composition in the form of a microemulsion which is suitable for cleaning hard surfaces, such as plastic, vitreous and metal surfaces, all of which may have shiny finishes. While the all-purpose cleaning composition may also be used in other cleaning applications, such as removing oily soils and stains from fabrics, it is primarily intended for cleaning hard, shiny surfaces, and desirably requires little or no rinsing. The improved cleaning compositions of the invention exhibit good grease removal actions, especially when used in concentrated form, and leave the cleaned surfaces shiny, sometimes without any need for rinsing them. Little or no residue will be seen on the cleaned surfaces, which overcomes one of the significant disadvantages of various prior art products, and the surfaces will shine, even after little or no wiping thereof. Suprisingly, this desirable cleaning is accomplished even in the absence of polyphosphates or other inorganic or organic detergent builder salts and often also in the absence of non-perfume solvent components, as grease removing solvents, such as hydrocarbons.

In one aspect of the invention a stable, clear, all-purpose hard surface cleaning composition which is especially effective in the removal of oily and greasy soils from hard surfaces is in the form of a substantially concentrated or somewhat diluted oil-in-water microemulsion. The aqueous phase of such an o/w microemulsion usually includes, on a weight basis, 5 to 65% of anionic synthetic organic detergent and/or nonionic synthetic organic detergent, 2 to 50% of substantially water insoluble perfume (which may omit or include terpene components), 2 to 50% of a water miscible co-surfactant having little or no capability of dissolving oily or greasy soil, and 15 to 85% of water, said proportions being based upon the total weight of the composition. The dispersed oil phase of the o/w microemulsion is composed essentially of the preferred water immiscible or hardly water soluble perfume but hydrocarbon solvent may also be present in such phase.

Preferred concentrations of the mentioned components of the concentrated microemulsion are 5 to 30% of synthetic organic detergent, 2 to 20% of perfume, 2 to 50% of co-surfactant and 50 to 85% of water. At such preferred concentrations, upon dilution of one part of concentrate with four parts of water the resulting microemulsion will be low in detergent and solvent contents, which may be desirable to avoid excessive foaming and to prevent destabilization of the emulsion due to too great a content of lipophilic phase therein after dissolving in the perfume or suitable hydrocarbon or other solvent of the oily or greasy soil to be removed from a substrate to be cleaned. Because of the absence of builders when the cleaning composition consists of or consists essentially of the described components (with minor proportions of compatible adjuvants being permissible), a chalky appearance of the clean surface is avoided and rinsing may be obviated. Among the desirable adjuvants that may be present in the microemulsions are divalent or polyvalent metal salts, as sources of magnesium and aluminum, for example, which improve cleaning performances of the dilute compositions, and higher fatty acids and/or higher fatty acid soaps, which act as foam supressants. Of course, if it is considered aesthetically desirable for the normally clear microemulsions to be cloudy or pearlescent in appearance, an opacifying or pearlescing agent may be present and in some instances, when it is not considered disadvantageous to have to rinse the builder off the substrate, builder salts, such as polyphosphates, may be present in the microemulsions, but it should be stressed that normally builders will be absent from them.

Some preferred "dilute" microemulsion cleaning compositions of this invention are those which are of formulas such as are producible by mixing four parts by weight of water with one part by weight of the concentrated emulsion previously described. In such "dilute" compositions the preferred proportions of components will be 1 to 13% of anionic synthetic organic detergent and/or nonionic synthetic organic detergent, 0.4 to 10% of substantially water insoluble perfume, 0.4 to 10% of water miscible co-surfactant having either limited ability or substantially no ability to dissolve oily or greasy soil, and 83 to 97% of water. More preferred ranges of components in such dilute composition are 1 to 6%, 0.4 to 4%, 0.4 to 10% and 90 to 97%, respectively. When other dilutions are employed, from 1:1 to 1:19 of concentrated microemulsion : water, the percentages of such ranges and preferred ranges should be adjusted accordingly. In some instances dilutions to 1:99 are feasible and such diluted compositions may be used as is or may be further diluted in some applications, as when employed for hand dishwashing (with rinsing).

Although most of the microemulsions of this invention are of the oil-in-water (o/w) type, some may be water-in-oil (w/o), especially the concentrates. Such may change to o/w on dilution with water, but both the o/w and w/o microemulsions can be clear and stable. However, the preferred detergent compositions are oil-in-water microemulsions, whether as concentrates or after dilution with water, with the essential components thereof being detergent, perfume, co-surfactant and water.

Surprisingly, although the perfume component of the present microemulsions is not considered to be a solvent for greasy or oily soil, the invented compositions, in diluted form, have the capacity to solubilize up to about 10 times or more (based on the weight of the perfume) of oily and greasy soil, which is loosened and removed from a substrate by action of the anionic and/or nonionic detergents (which may be referred to as surfactants), and is dissolved in the oil phase of the o/w microemulsion. Such unexpectedly beneficial solubilizing action of the perfume or dispersed phase could also be attributable to the very small (sub-micron) particle sizes of the globular dispersed liquid perfume "particles", which constitute the dispersed oily phase, because such particles have greatly increased surface areas and consequent increased solubilizing activity.

According to the present invention, the role of solvent for the oily soil is played by a water insoluble perfume, or one which is essentially water insoluble with such solubility normally being less than 2%). Typically, in water based detergent compositions the presence of a "solubilizer", such as alkali metal lower alkyl aryl sulfonate hydrotrope, triethanolamine, urea, etc., has been required to dissolve or satisfactorily disperse perfume, especially at perfume levels of about 1% and higher, because perfumes are normally mixtures of essential oils and odoriferous compounds which are essentially water insoluble. Therefore, by incorporating the perfume into the aqueous cleaning composition as the oil phase of the ultimate o/w microemulsion detergent composition, several different important advantages are achieved.

First, the cosmetic properties of the ultimate composition are improved. The compositions made are often clear (as a consequence of the formation of a microemulsion) and are very highly fragranced (as a consequence of the perfume level).

Second, any need for use of solubilizers, which do not contribute significantly to cleaning performance, is eliminated.

Third, an improved grease removal capacity in uses of both the concentrated and diluted cleaning compositions results, without any need for the presences of detergent builders, buffers or conventional grease removal solvents, at both neutral and acidic pH's and at low levels of active ingredients, and improved cleaning performances are obtainable.

As employed herein and in appended claims the term "perfume" is used in its ordinary sense to refer to and include any essentially water insoluble fragrant substance or mixture of substances including natural (i.e., obtained by extraction of flowers, herbs, leaves, roots, barks, wood, blossoms or plants), artificial (i.e., a mixture of different natural oils or oil constituents) and synthetic (i.e., synthetically produced) odoriferous substances. Such materials are often accompanied by auxiliary materials, such as fixatives, extenders and stabilizers, and such are also included within the meaning of "perfume", as employed in this specification. Typically, perfumes are complex mixtures of a plurality of organic compounds such as odoriferous or fragrant essential oils, esters, ethers, aldehydes, alcohols, hydrocarbons, ketones, and lactones, but various other classes of materials may also be present, such as pyrrones, and pyrroles.

Among components of different types of perfumes that may be employed are the following: essential oils—pine, balsam, fir, citrus, evergreen, jasmine, lily, rose and ylang ylang; esters—phenoxyethyl isobutyrate, benzyl acetate, p-tertiary butyl cyclohexyl acetate, guaiacwood acetate, linalyl acetate, dimethylbenzyl carbinyl acetate, phenylethyl acetate, linalyl benzoate, benzyl formate, ethylmethylphenyl glycidate, allylcyclohexane propionate, styrallyl propionate and benzyl salicylate; ethers—benzyl-ethyl ether; aldehydes—alkyl aldehydes of 8 to 18 carbon atoms, bourgeonal, citral, citronellal, citronellyl oxyacetaldehyde, cyclamen aldehyde, hydroxycitronellal and lilial; alcohols—anethol, citronellol, eugenol, geraniol, linalool, phenylethyl alcohol and terpineol; hydrocarbons—balsams and terpenes; ketones—ionones, alpha-isomethyl ionone, and methylcedryl ketone; lactones—gamma-alkyl lactone wherein the alkyl is of 8 to 14 carbon atoms; pyrrones—hydroxy-lower alkyl pyrrone wherein the alkyl is of 1 to 4 carbon atoms; and pyrroles—benzopyrrole.

Although the components mentioned above are preferred in perfumes utilized in this invention various other perfumery materials may also be employed including pine oil, lemon oil, lime oil, orange oil, bergamot oil, sweet orange oil, petitgrain bigarade oil, rosemary oil, methyl anthranilate, dimethyl anthranilate, indole, jasmine oil, patchouly oil, vetiver bourbon oil, vanillin, ethyl vanillin, coumarin, 3-methyl nonan-3-yl-acetate, methyl ionone, synthetic lily of the valley oil, synthetic red rose oil, 3-methyl nonan-3-ol, alpha-amyl cinnamic aldehyde, methyl salicylate, amyl salicylate, lavandin, isobutyl heptenone, cedryl acetate, ethyl linalyl acetate, neryl acetate, nerol, d-limonene, cuminic aldehyde, linalyl propionate, nerolidyl acetate, nerolidyl formate, alpha-pinene, isobutyl linalool, methylnaphthylketone, linalyl isobutyrate, paracresyl caprylate, paracresyl phenolacetate, sandalwood oil, coriander oil, sassafras oil, cassia oil, angelica root oil, Peruvian balsam, clove oil, mace oil, menthol, oils of peppermint and spearmint, and almond oil.

In addition to the named fragrance components there may also be employed fixative type materials, including musk, civet, castoreum, ambergris, gum benzoil, musk ambrette, musk ketone, musk xylol, oleoresin orris root, resinoid benzoil Siam and resinoid opopanax, as well as various other resins, gums, synthetic musks and other fixatives. Also often present in the perfumes are preservatives, antioxidants, stabilizers and viscosity and volatility modifiers, known for such functions.

The essential oils, which are normally present in the perfumes utilized in the invented cleaning compositions will normally contain terpenes, and often the terpene content of such oils, which may also be the terpene content of the perfume of the cleaning composition, can be up to 80%. Usually it is in the range of 10 to 70% of the perfume, preferably 30 to 70% thereof. The essential oils and their terpene components are useful solvents for lipophiles and for other perfume components, and applicants have found that their solubilizing properties and those of the other perfume components are surprisingly enhanced by the other components of the present compositions, as well as by the microemulsion form of the invented cleaners.

While various components of perfumes that are considered to be useful in the invented composition have been described above, the particular composition of the perfume is not considered to be critical with respect to cleaning properties so long as it is water insoluble (and has an acceptable fragrance). For use by the housewife or other consumer in the home, the perfume, as well as all other components of these cleaners, should be cosmetically acceptable, i.e., non-toxic, hypoallergenic, etc.

The perfume is present in the concentrated microemulsions in a proportion in the range of 2 to 50%, preferably 3 to 10% and more preferably 4 to 6% or 4.5 to 5.5%, e.g., about 5%. Corresponding perfume contents for the diluted microemulsions, as diluted to 1/5 concentrations, are 0.4 to 10%, 0.6 to 2%, 0.8 to 1.2%, 0.9 to 1.1% and 1%, respectively. If the proportion of perfume is less than about 0.4% in the dilute cleaner it may be difficult to form the desired microemulsion. If the perfume is present in a proportion greater than 10% the cost is increased without appreciable additional cleaning benefit. In fact, sometimes there may then be a diminution in cleaning because the total weight of greasy or oily soil which can be taken up in the oil phase of the microemulsion may be decreased. It is usually preferred that the perfume content in the dilute microemulsions should be less than 5% and preferably less than 3 or 4%. Sometimes a portion of the perfume may be replaced by hydrocarbon solvent, but such is usually only a minor proportion.

Superior grease removal performance may be achieved for cleaners containing perfumes that do not contain any terpene components but it is difficult for perfumers to formulate sufficiently inexpensive perfume compositions for products of this type (i.e., very competitive and cost sensitive consumer products), which include less than about 20% or 30%, of terpenes in the perfume, on a perfume basis. Therefore, even if only as a practical matter, based on economic considerations, the dilute o/w microemulsion cleaning compositions of the present invention will often include in the range of 0.2% to 7%, based on the total cleaning composition, of terpenes introduced via the perfume. However, even when the amount of terpene solvent in the dilute cleaning formulation is in the lower part of the range given, below 3%, such as 0.4 or 0.6 to 1.5%, satisfactory grease removal and oil removal capacity are achieved and good cleaning and oily soil removal result even when no terpenes are present in the perfume. The corresponding ranges for the concentrate are 1 to 35%, below 15%, and 2 or 3 to 7.5%.

For a typical formulation of a dilute o/w microemulsion according to this invention a 20 milliliter sample of o/w microemulsion containing 1% by weight of perfume (about 0.2 ml.) will be able to solubilize, for example, up to about 2 to 3 ml. of greasy and/or oily soil, while retaining its microemulsion form, whether the perfume contains 0%, 10%, 20%, 30%, 40%, 50%, 60%, 70%, or 80% thereof, of terpenes. In other words, it is an essential feature of the compositions of this invention that oil and grease removal thereby is a function of the nature of the total composition and its microemulsion state, and not of the presence in or absence from the microemulsion of terpenes or hydrocarbon solvent for oily and greasy soils.

The synthetic organic detergent component of the present cleaning compositions may be an anionic detergent or a nonionic detergent but mixtures of anionic and nonionic detergents are preferred. References herein in the singular to anionic detergent or nonionic detergent (and to other materials) include mixtures of such anionic detergents or nonionic detergents (and other materials). Such components may sometimes be referred to herein as surfactants because they are surface active but if so referred to they should be considered to be primary surfactants to distinguish over co-surfactants, which will be described in some detail hereafter.

Suitable water-soluble non-soap anionic synthetic organic detergents comprise those surface active or detergent compounds which include an organic hydrophobic moiety of 8 to 26 carbon atoms and preferably 10 to 18 carbon atoms in their molecular structure and at least one hydrophilic moiety selected from the group of sulfonates, sulfates and carboxylates, so as to form a water soluble detergent. Usually the hydrophobic moiety will include or comprise a $C_{8-22}$ alkyl, alkenyl or acyl. Such detergents are employed in the form of water soluble salts and the salt-forming cation usually is sodium, potassium, ammonium, magnesium or mono-, di- or tri-$C_{2-3}$ alkanolammonium, with sodium, magnesium and ammonium being preferred.

Examples of suitable sulfonated anionic detergents are the well known higher alkyl mononuclear aromatic sulfonates, such as the higher alkyl benzene sulfonates containing 9 to 18 or preferably 9 or 10 to 15 or 16 carbon atoms in the higher alkyl group in a straight or branched chain, $C_{8-15}$ alkyl toluene sulfonates and $C_{8-15}$ alkyl phenol sulfonates. A preferred sulfonate is linear alkyl benzene sulfonate having a higher content of 3- (or higher) phenyl isomers and a correspondingly lower content (well below 50%) of 2- (or lower) phenyl isomers, such as those sulfonates wherein the benzene ring is attached mostly at the 3 or higher (for example, 4, 5, 6 or 7) position of the alkyl group and the content of the isomers in which the benzene ring is attached in the 2 or 1 position is correspondingly low. Particularly preferred materials are set forth in U.S. Pat. No. 3,320,174, especially when the alkyls are of 10 to 13 carbon atoms.

Other suitable anionic detergents are the olefin sulfonates, including long chain alkene sulfonates, long chain hydroxyalkane sulfonates, and mixtures of alkene sulfonates and hydroxyalkane sulfonates. These olefin sulfonate detergents may be prepared in a known manner by the reaction of sulfur trioxide with long chain olefins containing 8 to 25 carbon atoms, preferably 12 to 21 carbon atoms, and being of the formula $R^4CH{=}CHR^5$, wherein $R^4$ is higher alkyl of 6 to 23 carbons and $R^5$ is alkyl of 1 to 17 carbon atoms, or hydrogen, to form a mixture of sultones and alkene sulfonic acids, in which sultones are then converted to sulfonates. Preferred such olefin sulfonates contain from 9 to 18 carbon atoms and more preferably contain 13–17 or 14 to 16 carbon atoms, and are obtained by sulfonating an alpha-olefin.

Additional useful anionic sulfonate detergents are the paraffin sulfonates containing about 10 to 20 carbon atoms, preferably 9 to 18 and more preferably 13 to 17 carbon atoms. Primary paraffin sulfonates are made by reacting long chain alpha olefins and bisulfites. Paraffin sulfonates having the sulfonate group distributed along the paraffin chain are described in U.S. Pat. Nos. 2,503,280; 2,507,088; 3,260,744; and 3,372,188; and in German patent 735,096.

Examples of satisfactory anionic sulfate detergents are the $C_{8-18}$ alkyl sulfate salts and the $C_{8-18}$ alkyl ether polyethenoxy sulfate salts having the formula $R^6(OC_2H_4)_n OSO_3M$ wherein $R^6$ is alkyl of 8 or 9 to 18 carbon atoms, n is 1 to 22, preferably 1 to 5, and M is a solubilizing cation selected from the group consisting of sodium, potassium, ammonium, magnesium and mono-, di- and tri-ethanolammonium ions. The alkyl sulfates may be obtained by sulfating the alcohols obtained by reducing glycerides of coconut oil or tallow or mixtures thereof, and neutralizing the resultant organic sulfuric acid ester. The alkyl ether polyethenoxy sulfates may be made by sulfating the condensation product of ethylene oxide and $C_{8-18}$ alkanol, and neutralizing the resultant product. The alkyl ether polyethenoxy sulfates differ from one another in the number of carbon atoms in the alcohols and in the number of moles of ethylene oxide reacted with one mole of such alcohol. Preferred alkyl sulfates and preferred alkyl ether polyethenoxy sulfates contain 10 to 16 carbon atoms in the alcohols and in the alkyl groups thereof, e.g., sodium lauryl sulfate, sodium myristyl (3 EtO) sulfate.

$C_{8-18}$ Alkylphenyl ether polyethenoxy sulfates containing from 2 to 6 moles of ethylene oxide in the molecule also are suitable for use in the inventive microemulsion compositions. These detergents can be prepared by reacting an alkyl phenol with 2 to 6 moles of ethylene oxide and sulfating and neutralizing the resultant ethoxylated alkylphenol.

Of the foregoing non-soap anionic synthetic organic detergents these that are considered to be most preferred are the $C_{9-15}$ linear alkylbenzene sulfonates and the $C_{13-17}$ paraffin or alkane sulfonates. Particularly, preferred compounds are sodium $C_{10-13}$ alkylbenzene sulfonate and sodium $C_{13-17}$ alkane sulfonate.

The water soluble or water dispersible nonionic synthetic organic detergents that are employed in the invented cleaning compositions are usually condensation products of an organic aliphatic or alkylaromatic hydrophobic compound and ethylene oxide, which is hydrophilic. Almost any hydrophobic compound having a carboxy, hydroxy, amido or amino group with a free hydrogen present can be condensed with ethylene oxide or with polyethylene glycol to form a nonionic detergent. The length of the polyethenoxy chain of the condensation product can be adjusted to achieve the desired balance between the hydrophobic and hydrophilic elements (hydrophilic-lipophilic balance, or HLB) and such balances may be estimated as HLB numbers.

Particularly suitable nonionic detergents are the condensation products of a higher aliphatic alcohol, containing about 8 to 18 carbon atoms in a straight or branched chain configuration, condensed with about 2 to 30, preferably 2 to 10 moles of ethylene oxide. A particularly preferred compound is $C_{9-11}$ alkanol ethoxylate of five ethylene oxides per mole (5 EtO), which also may be designated as $C_{9-11}$ alcohol EO 5:1, $C_{12-15}$ alkanol ethoxylate (7 EO) or $C_{12-15}$ alcohol EO 7:1 is also preferred. Such nonionic detergents are commercially available from Shell Chemical Co. under the trade names Dobanol 91-5 and Neodol 25-7.

Other suitable nonionic detergents are the polyethylene oxide condensates of one mole of alkyl phenol containing from about 6 to 12 carbon atoms in a straight- or branched-chain configuration, with about 2 to 30, preferably 2 to 15 moles of ethylene oxide, such as nonyl phenol condensed with 9 moles of ethylene oxide, dodecyl phenol condensed with 15 moles of ethylene oxide, and dinonyl phenol condensed with 15 moles of ethylene oxide. These aromatic compounds are not as desirable as the aliphatic alcohol ethoxylates in the invented compositions because they are not as biodegradable.

Another well known group of usuable nonionic detergents is marketed under the trade name "Pluronics". These compounds are block copolymers formed by condensing ethylene oxide with a hydrophobic base formed by the condensation of propylene oxide with propylene glycol. The molecular weight of the hydrophobic portion of the molecule is of the order of 950 to 4,000, preferably 1,200 to 2,500. The condensation of ethylene oxide with the hydrophobic moiety increases the water solubility of the molecule. The molecular weight of these polymers is in the range of 1,000 to 15,000, and the polyethylene oxide content may comprise 20 to 80% thereof.

Still other satisfactory nonionic detergents are a condensation products of a $C_{10-16}$ alkanol with a heteric mixture of ethylene oxide and propylene oxide. The mole ratio of ethylene oxide to propylene oxide is from 1:1 to 4:1, preferably from 1.5:1 to 3.0:1, with the total weight of the ethylene oxide and propylene oxide contents (including the terminal ethanol group or propanol group) being from 60% to 85%, preferably 70% to 80%, of the molecular weight of the nonionic detergent. Preferably, the higher alkanol contains 12 to 15 carbon atoms and a preferred compound is the condensation product of $C_{13-15}$ alkanol with 4 moles of propylene oxide and 7 moles of ethylene oxide. Such preferred compounds are commercially available from BASF Company under the trade name Lutensol LF.

Also suitable for incorporation in the invented cleaning compositions are the nonionic detergents that are derived from the condensation of ethylene oxide with the product resulting from the reaction of propylene oxide and ethylene diamine. For example, satisfactory such compounds contain from about 40 to 80% of polyoxyethylene by weight, have a molecular weight of from about 5,000 to 11,000, and result from the reaction of ethylene oxide with a hydrophobic base which is a reaction product of ethylene diamine and excess propylene oxide, and which is of a molecular weight in the range of 2,500 to 3,000.

Additionally, polar nonionic detergents may be substituted for the generally non-polar nonionic detergents described above. Among such polar detergents are those in which a hydrophilic group contains a semi-polar bond directly between two atoms, for example, N—O and P—O. There is charge separation between such directly bonded atoms, but the detergent molecule bears no net charge and does not dissociate into ions. Suitable such polar nonionic detergent include open chain aliphatic amine oxides of the general formula wherein $R^7$-$R^8$-$R^9$N—O, wherein $R^7$ is an alkyl, alkenyl or monohydroxyalkyl radical having about 10 to 16 carbon atoms and $R^8$ and $R^9$ are each selected from the group consisting of methyl, ethyl, propyl, ethanol, and propanol radicals. Preferred amine oxides are the $C_{10-16}$ alkyl dimethyl and dihydroxyethyl amine oxides, e.g., lauryl dimethyl amine oxide and lauryl myristyl dihydroxyethyl amine oxide. Other operable polar nonionic detergents are the related open chain aliphatic phosphine oxides having the general formula $R^{10}R^{11}R^{12}P$—O wherein $R^{10}$ is an alkyl, alkenyl or monohydroxyalkyl radical of a chain length in the range of 10 to 18 carbon atoms, and $R^{11}$ and $R^{12}$ are each alkyl or monohydroxyalkyl radicals containing from 1 to 3 carbon atoms. As with the amine oxides, the preferred phosphine oxides are the $C_{10-16}$ alkyl dimethyl and dihydroxyethyl phosphine oxides.

Preferably, especially in dilute o/w microemulsion compositions of this invention, the nonionic detergent will be present in admixture with the anionic detergent. The proportion of nonionic detergent in such mixed detergent compositions, based on the final dilute o/w microemulsion composition, may be in the range of 0.1 to 8%, preferably 2 to 6%. The rest of the detergent component in such compositions will be anionic detergent. In more preferred compositions the weight ratio of anionic detergent to nonionic detergent will be in the range of 1:3 to 3:1 with especially good results being obtained at a weight ratio of 1.3:1 or thereabout. The more preferred anionic detergent plus nonionic detergent-based compositions are those in which the anionic detergent includes a paraffin sulfonate and/or an alkylbenzene sulfonate, and the nonionic detergent is a higher fatty alcohol polyethoxylate.

Many other suitable anionic and nonionic detergents that may be detersive components of the present microemulsion cleaning compositions are described in texts denoted to detergency, detergent compositions and components, including *Surface Active Agents* (*Their Chemistry and Technology*), by Schwartz and Perry, and the various annual editions of John W. McCutcheon's *Detergents and Emulsifiers.*

The co-surfactant component plays an essential role in the concentrated and diluted microemulsions of this invention. In the absence of the co-surfactant the water, detergent(s) and perfume (the only liponilic:material that is present), when mixed in appropriate proportions, will form either a micellar solution, at lower concentrations, or a conventional oil-in-water emulsion. With the presence of the co-surfactant in such systems the interfacial tension or surface tension at the interfaces between the lipophile droplets and the continuous aqueous phase is greatly reduced, to a value close to 0 ($10^{-3}$ dynes/cm.). This reduction of the interfacial tension results in spontaneous disintegration of the dispersed phase globules or droplets until they become so small that they cannot be perceived by the unaided human eye, and a clear microemulsion is formed, which appears to be transparent. In such microemulsion state thermodynamic factors come into balance, with varying degrees of stability being related to the total free energy of the microemulsion. Some of the thermodynamic factors involved in determining the total free energy of the system are (1) particle-particle potential; (2) interfacial tension or free energy (stretching and bending); (3) droplet dispersion entropy; and (4) chemical potential changes upon formation of the microemulsion. A thermodynamically stable system is achieved when interfacial tension or free energy is minimized and when droplet dispersion entropy is maximized. Thus, it appears that the role of the co-surfactant in formation of a stable o/w microemulsion is to decrease interfacial tension and to modify the microemulsion structure and increase the number of possible configurations. Also, it seems likely that the co-surfactant helps to decrease rigidity of the dispersed phase with respect to the continuous phase and with respect to the oily and greasy soils to be removed from surfaces to be contacted by the microemulsions.

The co-surfactants that are useful in the present microemulsion compositions include: a water soluble lower alkanol of 2 to 6 carbon atoms (sometimes preferably 2 or 3 to 4 carbon atoms), a polypropylene glycol of 2 to 18 propoxy units, a monoalkyl ether of a lower glycol of the formula $RO(X)_nH$ wherein R is $C_{1-4}$ alkyl and X is $CH_2CH_2O$, $CH(CH_3)CH_2O$ or $CH_2CH_2CH_2O$, and n is from 1 to 4, a monoalkyl ester of the formula $R^1O(X)_nH$ where $R^1$ is $C_{2-4}$ acyl and X and n are as immediately previously described, an aryl substituted lower alkanol of 1 to 4 carbon atoms, propylene carbonate, an aliphatic mono-, di-, or tri-carboxylic acid of 3 to 6 carbon atoms, a mono-, di- or tri-hydroxy substituted aliphatic mono-, di-, or tri-carboxylic acid of 3 to 6 carbon atoms, a higher alkyl ether poly-lower alkoxy carboxylic acid of the formula $R^2O(X)_nYCOOH$, wherein $R^2$ is $C_{9-15}$ alkyl, n is from 4 to 12, and Y is $CH_2$, $C(O)R^3$ or

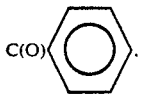

wherein $R^3$ is a $C_{1-3}$ alkylene, or a lower alkyl mono-, di-, or tri-ester of phosphoric acid, wherein the lower alkyl is of 1 to 4 carbon atoms, or any mixture thereof. Mixtures that may be used are mixtures of individual types of components and of different types.

Representative members of the mentioned polypropylene glycols include dipropylene glycol and polypropylene glycol having a molecular weight of 200 to 1,000, e.g., polypropylene glycol 400. Satisfactory glycol ethers and other glycol derivatives are ethylene glycol monobutyl ether (butyl cellosolve), diethylene glycol monobutyl ether (butyl carbitol), triethylene glycol monobutyl ether, tetraethylene glycol monobutyl ether, propylene glycol tertiary butyl ether, ethylene glycol monoacetate and dipropylene glycol propionate. Because they are capable of providing stable micro emulsions over a broad range of temperatures while avoiding any problems related to toxicity and/or environmental safety, two ethers based on dipropylene glycol are particularly preferred as co-surfactants. They are dipropylene glycol monobutyl ether and dipropylene glycol isobutyl ether, both of which are commercially available.

Representative aliphatic carboxylic acids include $C_{3-6}$ alkyl and alkenyl monobasic, dibasic and polybasic acids, such as glutaric acid, alone or with either or both of adipic and/or succinic acids, corresponding hydroxy acids, such as citric and tartaric acids, and mixtures thereof.

While all of the aforementioned glycol ether compounds and organic acids provide the described stability, the most preferred co-surfactant compounds of each type, on the basis of cost and cosmetic appearance (particularly odor), are diethylene glycol monobutyl ether, dipropylene glycol butyl and isobutyl ethers, and a mixture of adipic, glutaric and succinic acids. The ratio of acids in the foregoing acid mixture is not particularly critical and can be modified (often to provide an acceptable or desirable odor). To maximize water solubility of the acid mixture, glutaric acid, the most water-soluble of these three saturated aliphatic dibasic acids, will be a significant component and may be present in major proportion. Generally, weight ratios of adipic acid: glutaric acid: succinic acid are 1-3:1-8:1-5, respectively, preferably 1-2:1-6:1-3, such as 1:1:1, 1:2:1, 2:2:1, 1:2:1.5, 1:2:2, 2:3:2, etc.

A preferred example of the phosphoric acid ester co-surfactants is triethyl phosphate but the triisopropyl and tri-n-propyl phosphates are substitutable for all or part thereof, as are other known phosphoric esters.

The amount of co-surfactant employed to stabilize the microemulsion compositions will depend on such factors as the surface tension characteristics of the co-surfactant, the types and proportions of the detergents and perfumes, and the types and proportions of any additional components which are present in the composition and which have an influence on the thermodynamic factors previously enumerated. Generally, amounts of co-surfactant in a preferred range of 2% to 10%, more preferably 3 to 7%, and especially preferably 3.5 to 6%, provide stable dilute o/w microemulsions for the above-described levels of primary surfactants, perfume, and any other additives as described below, in the diluted microemulsions. Related ranges for concentrated microemulsions are obtained by multiplying the extremes of the given ranges by five.

The pH's of the final microemulsions, concentrated or dilute, will be dependent in large part on the identity of the co-surfactant compound, with the choice of the co-surfactant also being affected by cost and cosmetic properties, often particularly odor or fragrance. For example, microemulsion compositions which are to have a pH in the range of 1 to 10 may employ either an alkanol, propylene glycol, or ethylene glycol or propylene glycol ether or ester, or an alkyl phosphate as the sole co-surfactant but such pH range may be reduced to 1 to 8.5 when polyvalent metal salt is present. The organic acid co-surfactant will be used as the sole co-surfactant when the product pH is to be below 3.2. The alkyl ether poly-lower alkoxy acids may be the sole surfactants when the product pH is to be below 5. Mixtures of acidic and other co-surfactants can be employed to make neutral and near neutral compositions of pH of $7\pm1.5$, preferably $7\pm0.2$. The ability to formulate neutral and acidic products without builders, which nevertheless have desirable grease removal capacities, is an important feature of the present invention because the prior art o/w microemulsion formulations of such properties usually were required to be highly alkaline, highly built, or both alkaline and built.

In addition to their excellent capacity for cleaning greasy and oily soils, the low pH o/w microemulsion formulations of this invention also exhibit excellent other cleaning properties. They satisfactorily remove soap scum and lime scale from hard surfaces when applied in neat (undiluted) form, as well as when they are diluted. For such applications onto originally hard shiny surfaces having surface deposits of lime scale and/or soap scum, which may also be soiled with oily and greasy deposits, the microemulsions may be of a pH in the 0.5 to 6 range, preferably 1 to 4 and more preferably 1.5 to 3.5. For general cleaning of oily and greasy surfaces, without lime scale or soap scum deposits the pH may be in the range of 1 to 11 and sometimes 6–11 or 6–8 will be preferred and more preferred, respectively (for mildness and effectiveness).

The final essential component of the invented microemulsions is water. Such water may be tap water, usually of less than 150 p.p.m. hardness, as $CaCO_3$, but preferably will be deionized water or water of hardness less than 50 p.p.m., as $CaCO_3$. The proportion of water in the dilute o/w microemulsion compositions generally is in the range of 83 to 97%, preferably 90 to 97%, while for the concentrated microemulsions such ranges are 15 to 85% and 50 to 85%.

The concentrated and dilute clear o/w microemulsion liquid all-purpose cleaning compositions of this invention are effective when used as is, without further dilution by water, but it should be understood that some dilution, without disrupting the microemulsion, is possible, and often may be preferable, depending on the levels of surfactants, co-surfactants, perfume and other components present in the composition. For example, at preferred low levels of anionic and nonionic detergents, dilutions up to about 50% will be without any phase separation (the microemulsion state will be maintained), and often much greater dilutions are operative. Even when diluted to a great extent, such as 2- to 10-fold or more, for example, the resulting compositions are often still effective in cleaning greasy, oily and other types of lipophilic soils. Furthermore, the presence of magnesium ions or other polyvalent ions, e.g., aluminum, as will be described in greater detail below, further serves to boost cleaning performance of the primary detergents in diluted compositions.

It is within the scope of this invention to formulate various concentrated microemulsions which may be diluted with additional water before use. For example, some such concentrated microemulsions may be prepared by mixings of the following proportions of detergents, co-surfactant, perfume and water:

| | Percentage Ranges | |
|---|---|---|
| Component | Broader | Narrower (preferred) |
| Anionic detergent | 10–35 | 12–28 |
| Nonionic detergent | 8–30 | 10–20 |
| Co-surfactant | 2–30 | 4–15 |
| Perfume | 10–50 | 25–45 |
| Water | 10–50 | 22–40 |

Such concentrated microemulsions, like other such emulsions previously mentioned, can be diluted by mixing with up to about 20 times or more, even sometimes to 100 times, but preferably about 3 or 4 to about 10 times their weight of water, e.g., 4 times, to form o/w microemulsions similar to the diluted microemulsion compositions described above. While the degree of dilution is suitably chosen to yield an o/w microemulsion composition after dilution, it should be recognized that during and at the ends of dilutions, especially when diluting from w/o concentrated emulsions, both microemulsion and non-microemulsion stages may be encountered.

In addition to the above-described essential constituents, which are required for the formation of the microemulsion compositions, the compositions of this invention may often and preferably do contain one or more additional components which serve to improve overall product performance. One such material is an inorganic or organic salt, oxide or hydroxide of a bivalent or multivalent metal cation, preferably $Mg^{++}$. The metal salt, oxide or hydroxide provides several benefits, including improved cleaning performances in dilute usages, particularly in soft water areas, and minimizes the proportions of perfume (and/or hydrocarbon) employed to obtain the desired lipophile-solubilizing properties of the microemulsion state. Magnesium sulfate, either anhydrous or as a hydrate, e.g., its heptahydrate, is especially preferred as the magnesium salt. Good results are also obtained with magnesium oxide, magnesium chloride, magnesium acetate, magnesium propionate and magnesium hydroxide. These magnesium compounds can be used with formulations at neutral or acidic pH's because magnesium hydroxide does not precipitate at such lower pH levels.

Although magnesium is the preferred multivalent metal from which the salts employed (inclusive of the oxide and hydroxide) are formed, other polyvalent metal ions also can be used, provided that their salts are non-toxic and are soluble in the aqueous phase of the system at the desired pH level. Thus, depending on such factors as the pH of the system, the nature of the detergents and of the co-surfactant, and also on availability and cost factors, other suitable polyvalent metal ions, including aluminum, copper, nickel, iron and calcium may be employed. It should be noted, however, that with a preferred paraffin sulfonate anionic detergent, calcium salts will precipitate and should not be used. It has also been found that the aluminum salts work best at pH's below 5 or when a low level of citric acid, for example, about 1%, is added to the composition, when it is designed to have a neutral pH. Alternatively, the aluminum salt can be added directly as the citrate in such case. For aluminum and other multivalent metal salts, oxides and carbonates, the same general classes of anions as were mentioned for the magnesium salts can be used, such as halides, e.g., bromides and chlorides, sulfates, nitrates, hydroxides, oxides, acetates and propionates.

Preferably, in the dilute and concentrated microemulsion compositions the metal compound is present in the microemulsion in a proportion sufficient to provide a stoichiometric equivalence between any anionic detergent present and the metal cation. For example, for each gram-ion of $Mg^{++}$there will be two gram-moles of paraffin sulfonate, alkyl-benzene sulfonate, etc., while for each gram-ion of $Al^{3+}$there will be three gram-moles of anionic detergent. The proportion of the bivalent or multivalent salt will generally be selected so that one equivalent of cation therein will be present with 0.1 to 2.5 equivalents, preferably 0.9 to 1.1 equivalents, of the acid form of the anionic detergent. Instead of using a stoichiometric proportion of such a metal salt, etc., to react with the anionic detergent the metal salt of such detergent may be employed. In some instances where such metal salt or metal detergent salt is used, less than the stoichiometric proportion may be employed, but usually when such metal salt or metal detergent salt is present the proportion thereof will be at least 50% of stoichiometric, preferably 80 to 100%.

Optionally, the o/w microemulsion compositions may include minor proportions, e.g., 0.1 to 2.0%, preferably 0.25% to 1.0%, on a dilute product basis, of a $C_{8-22}$ fatty acid or fatty acid soap, as a foam suppressant. The addition of free higher fatty acid or fatty acid soap provides an improvement in the rinsability of the composition, whether the microemulsion is applied in neat or diluted form. Generally, however, it is desirable to increase the level of co-surfactant, as to 1.1 to 1.5 times its otherwise normal concentration, to maintain product stability when the free fatty acid or soap is present.

Examples of the fatty acids which can be used as such or in the form of soaps, include distilled coconut oil fatty acids, "mixed vegetable" type fatty acids (e.g., those of high percentages of saturated, mono- and/or polyunsaturated $C_{18}$ chains) oleic acid, stearic acid, palmitic acid, eicosanoic acid, and the like. Generally those fatty acids having from 8 to 22 carbon atoms therein are operative.

The all-purpose microemulsion cleaning compositions of this invention may, if desired, also contain other components, either to provide additional beneficial effects or to make the product more attractive to the consumer. The following are mentioned by way of examples: colors or dyes in proportions up to 0.5%; bactericides in proportions up to 1%; preservatives or antioxidizing agents, such as formalin, 5-bromo-5-nitrodioxan-1, 3, 5-chloro-2-methyl-4-isothaliazolin-3-one, 2,6-di-tert. butyl-p-cresol, in proportions up to 2%; and pH adjusting agents, such as sulfuric acid or sodium hydroxide, as needed. Furthermore, if opaque or pearlescent compositions are desired, up to 4% by weight of opacifier and/or pearlescing agent may be added. Although it is a desirable feature of this invention that builder salts are not needed (and they can interfere with rinsing and/or wiping of the cleaned substrate), builders may be present in dilute microemulsions. They are preferably omitted entirely from the concentrated microemulsions.

In the final diluted form, the all-purpose liquids are clear oil-in-water microemulsions and exhibit satisfactory stability at reduced and increased temperatures. More specifically, such compositions remain clear and stable in the range of 5° C. to 50° C., especially 10° C. to 43° C. They exhibit a pH in the acid, neutral or alkaline range, e.g., 1–11, depending on intended end use, with acidic and neutral pH's, e.g., 2 to 7 or 2 to 8 being preferred and with acidic pH's, e.g., 1–4 or 2–3.5 being considered best for lime scale and soap scum removal applications. The liquids are readily pourable and exhibit a viscosity in the range of 5 to 150 or 200 centipoises, preferably 6 to 60 centipoises (cps.) and more preferably 10 to 40 cps., as measured at 25° C. with Brookfield RVT Viscometer, using a No. 1 spindle rotating at 20 r.p.m. Usually, the product viscosity, in the absence of thickening agent, will be no greater than 100 cps., even for the concentrated microemulsions, but by addition of thickeners, such as lower alkyl celluloses and hydroxy-lower alkyl celluloses, e.g., methyl cellulose, hydroxypropyl methyl cellulose, and water soluble resins, e.g., polyacrylate, polyacrylamide, polyvinyl alcohol, increased viscosities are obtainable.

The compositions, in either concentrated or diluted form, are ready for direct use or can be diluted as desired, before application. In either case little or no rinsing is usually required and substantially no residue or streaks are left behind. Furthermore, because the compositions are preferably free of detergent builders, such as alkali metal polyphosphates, they are environmentally acceptable, and provide the additional benefit of a better "shine" on cleaned hard surfaces, without the need for much rinsing and wiping. When rinsing is considered desirable, the amount of water used for the rinse may be minimized, often being less than ten times the weight of microemulsion applied.

The liquid compositions are preferably packaged in manually operated spray dispensing containers of synthetic organic polymeric plastic, e.g., PVC, polyethylene or polypropylene, which may include nylon closure, valve and nozzle parts, but they can also be packaged under pressure in aerosol containers. Such products, including the dispensers provided, are especially suitable for so-called spray-and-wipe applications, but in the present operations wiping may be omitted and relatively little rinsing may be substituted for it.

Because the compositions, as prepared, are aqueous liquid formulations and because often no particular mixing procedure is required to be followed to cause formation of the desired microemulsions, the compositions are easily prepared, often simply by combining all of the components thereof in a suitable vessel or container. The order of mixing the ingredients in such cases is not particularly important and generally the various materials can be added sequentially or all at once or in the form of aqueous solutions or each or all of the primary detergents and co-surfactants can be separately prepared and combined with each other, followed by the perfume. The magnesium salt, or other multivalent metal compound, when present, can be added to the water or to the detergent solution, as an aqueous solution, or can be added directly. It is not necessary to use elevated temperatures in the manufacturing of the microemulsions, room temperature being sufficient, with temperatures in the range of 5° to 50° C. being satisfactory and those of 10° to 43° C. especially 20° to 30° C., being preferred. However, to avoid any problems with the microemulsions breaking or not forming properly one may make a solution of the synthetic detergent(s) in water, dissolve the co-surfactant therein, and then admix in the perfume, which thus spontaneously forms the concentrated or dilute microemulsion, which operations are conducted at a temperature in the 5° to 50° C. range, preferably 10° to 43° C., and more preferably, 20° to 30° C., If fatty acid is to be employed for its antifoaming effect it will preferably be melted and added to the surfactant - co-surfactant solution, followed by the perfume. Dilute microemulsions can be made from the concentrated microemulsion by dilution with at least 50% thereof of water, with both the microemulsion and the water being in the described temperature range. The products resulting are of dispersed lipophilic phase droplet sizes in the range of 50 to 1,500Å, preferably 100 to 500Å, with the smaller particle sizes promoting better absorption of oily soils from soiled substrates to be cleaned.

The following examples illustrate liquid cleaning compositions of the present invention. Unless otherwise specified, all percentages and parts given in these examples, this specification and the appended claims are by weight and all temperatures are in ° C. The exemplified compositions are illustrative only and do not limit the scope of the invention.

EXAMPLE 1

The following composition is prepared:

| | Percent |
|---|---|
| Sodium $C_{13-17}$ paraffin sulfonate | 4.0 |
| $C_{9-11}$ Alcohol EO5:1 (Dobanol 91-5) | 3.0 |
| Ethylene glycol monobutyl ether | 5.0 |
| *Perfume (mix of essential oils, esters, ethers and aldehydes) | 1.0 |
| $MgSO_4 \cdot 7\ H_2O$ | 1.5 |
| Water | 85.5 |

-continued

| | Percent |
|---|---|
| pH of product: 7.0 ± 0.2 | 100.00 |

*contains about 2% by weight of terpenes

This composition is made at room temperature (25° C.) by dissolving the detergent and Epsom salts in the water and then dissolving the ethylene glycol monobutyl ether in such solution, followed by admixing in the perfume to form a stable clear homogeneous o/w microemulsion. As a measure of "dissolving power" of this composition for water-insoluble liquids, 100 grams of the liquid are placed in a beaker and liquid pentane is added dropwise to the liquid, with gentle agitation, until the composition turns from clear to cloudy. 18 Grams of pentane are solubilized and the liquid remains clear and homogeneous. Similarly, when petroleum ether (b.p.=60°-80° C.) is used as the water-insoluble liquid, 15 grams can be "dissolved" in the liquid o/w microemulsion without resulting in phase separation and without the liquid becoming cloudy.

The "dissolving power" of the o/w microemulsion of this example is compared to the "dissolving power" of an composition which is identical except that an equal proportion (5%) of sodium cumene sulfonate hydrotrope is used in place of the ethylene glycol monobutyl ether co-surfactant in a test wherein heptane is added to both compositions. The o/w microemulsion of this invention solubilizes 12.6 grams of the heptane, compared to 1.4 grams that are solubilized by the hydrotrope-containing composition.

In a further comparative test, using blue colored cooking oil (a fatty triglyceride soil), the composition of Example 1 is clear after the addition of 0.2 gram of cooking oil whereas the cooking oil floats on the top of the composition containing the hydrotrope.

When the concentration of perfume is reduced to 0.4% in the composition of Example 1, a stable o/w microemulsion composition is obtained. Similarly, a stable o/w microemulsion is obtained when the concentration of perfume is increased to 2% by weight and when the concentration of co-surfactant is increased to 6% by weight.

Similar results are obtained when the described invented compositions are employed to clean painted woodwork on which a greasy deposit of lard has been smeared. Cleaning is at room temperature and is effected by spraying the microemulsion from a plastic spray bottle onto the surface to be cleaned, followed by wiping and natural drying. The cleaned surface is shiny, without the need for rinsing, buffing or polishing.

EXAMPLE 2

This example illustrates a typical formulation of a "concentrated" o/w microemulsion based on the present invention:

| | Percent |
|---|---|
| Sodium $C_{13-17}$ paraffin sulfonate | 20 |
| $C_{9-11}$ Alcohol EO5:1 | 15 |
| Ethylene glycol monobutyl ether | 20 |
| *Perfume | 15 |
| Water | 30 |
| pH of microemulsion: 7.0 ± 0.2 | 100 |

This concentrated formulation is made in the manner described in Example 1, and is then diluted, with five times its weight of tap water, to yield a diluted o/w microemulsion composition. Thus, by using microemulsion technology it becomes possible to provide a product having high levels of active detergent ingredients and perfume, which has high consumer appeal in terms of clarity, odor and stability, and which is easily diluted to a usage concentration for similar all-purpose hard surface liquid cleaning compositions, while retaining its cosmetically attractive attributes.

Both such formulations are used successfully without further dilution, in the manner described in Example 1, at room temperature. They are also used successfully at full or diluted strengths to pre-spot or clean soiled fabrics by hand or in an automatic laundry washing machine.

When the percentage of water in the formula is very much decreased the emulsion or microemulsion made is of the w/o type, but it can form an o/w microemulsion upon dilution with water, in the manner previously described.

EXAMPLE 3

This example illustrates a diluted o/w microemulsion composition according to the invention, having an acidic pH, which removes greasy soils from hard surfaces, such as linoleum floors and walls, and additionally, removes soap scum and lime scale from bathtubs and other bathroom fixtures.

| | Percent |
|---|---|
| Sodium $C_{13-17}$ paraffin sulfonate | 4.0 |
| $C_{9-11}$ alcohol EO 5:1 | 3.0 |
| $MgSO_4.7H_2O$ | 1.5 |
| Mixture of succinic acid/glutaric acid/adipic acid (about 1:1:1) | 5.0 |
| **Perfume | 1.0 |
| Water, minor components (dyes, etc.) | 85.5 |
| | 100.0 |

**contains about 40% by weight of terpenes

The pH of the resulting microemulsion is 2.5±0.2.

The clear o/w microemulsion of this invention is made by the process of Example 1, with the acids mixture being dissolved in the aqueous detergent solution, after which the perfume is admixed, and with all materials being at room temperature (20° C.). The microemulsion is filled into spray bottles and is used to clean tile shower walls and floors of lime scale and soap scum that had adhered to them. After spraying on of the microemulsion it is wiped off, rinsed with a little water (less than 10 times the microemulsion weight) and allowed to dry to a good shine.

When the dilute microemulsion of this example is compared to that of the formula given in Example 1 in dynamic tests of powers to remove soap scum and lime scale the Example 3 product is definitely superior, requiring ¼ as many sponge strokes (25 vs. 100) to remove a test soap scum from a tile surface, and being visually clearly better in removing lime scale from a glass surface after only 10 sponge strokes.

EXAMPLE 4

This example describes a dilute o/w microemulsion composition according to the invention, in which magnesium dodecylbenzene sulfonate is the anionic detergent, which is formed in situ.

| | Percent |
|---|---|
| Magnesium oxide | 0.33 |
| Linear dodecylbenzene sulfonic acid | 5.25 |
| $C_{9-11}$ alcohol EO 7.5-8:1 | 1.75 |
| Diethylene glycol monobutyl ether | 4.00 |
| Perfume (2% terpenes) | 1.00 |
| Water | 87.67 |
| | 100.00 |

The foregoing composition is prepared by dispersing the magnesium oxide in water followed by the addition of the dodecylbenzene sulfonic acid, with agitation, to form the neutralized sulfonate. Thereafter, the nonionic detergent, the co-surfactant and the perfume are added in sequence to form an o/w microemulsion composition having a pH of 7.0±0.2. The composition is useful to remove greasy soil, such as lard, from test plates, tiles and even from fabrics, without rinsing being needed to clean the hard surfaced items. Similar good results are obtainable by substituting the others of the disclosed co-surfactants for the diethylene glycol monobutyl ether (DEGMBE), alone or in various mixtures thereof.

EXAMPLE 5

The compositions of Examples 1 and 3 are prepared by replacing the Epsom salts with 0.2% of MgO (i.e., an equivalent molar amount) and satisfactory clear o/w microemulsion cleaning compositions like those of Examples 1 and 3, and of similar good cleaning properties are obtained.

EXAMPLE 6

This example shows typical dilute o/w microemulsion compositions according to this invention which contain a fatty acid foam controller, which suppresses foam.

| | Percent | |
|---|---|---|
| | A | B |
| Sodium $C_{13-17}$ paraffin sulfonate | 4.0 | 4.0 |
| $C_{9-11}$ alcohol EO 5:1 | 3.0 | 3.0 |
| Magnesium oxide | 0.25 | 0.25 |
| Distilled coconut oil fatty acids ($C_{8-18}$) | 0.5 | 0.5 |
| Diethylene glycol monobutyl ether | 5.0 | |
| Ethylene glycol monobutylether | | 5.0 |
| Perfume | *1.0 | ***1.0 |
| Dye | 0.0015 | 0.0015 |
| $H_2SO_4$ or NaOH (for pH adjustment) | to pH 6.8 | ±0.2 |
| Formalin | 0.2 | 0.2 |
| Antioxidant | 0.1 | 0.1 |
| $H_2O$ | 85.9485 | 85.9485 |
| | 100.00 | 100.00 |

*contains 2% of terpenes, approximately
***contains 70% of terpenes, approximately In manufacturing such microemulsions the fatty acids are first melted and added to the surfactant-co-surfactant solutions, followed by the perfume. The other components may be admixed at appropriate and convenient stages.

The clear essentially neutral cleaning microemulsions resulting are useful for direct spraying onto oily and greasy, previously shiny surfaces to be cleaned, and after application thereto and after remaining on the surfaces for 1 to 3 minutes, are removed by wiping, after which the surfaces are allowed to dry to attractive lustres. Because of their contents of foam control agent the sprays foam only a little when the microemulsions are applied. Such foam control is also noticeable when the microemulsions are charged to aerosol spray containers, from which they may be discharged as sprays onto greasy surfaces to be cleaned. Similar results are obtainable when other anionic detergents replace the paraffin sulfonate and when proportions of the various components are varied ±10%, ±20% and ±40%, while remaining within the ranges disclosed in the specification.

In variations of the formula perfumes of various terpene contents over the range of 2 to 90% are employed instead of the 2% and 70% contents, such as 15%, 35%, 55%, 75% and 85%, and the same types of results will be obtained.

EXAMPLE 7

This example illustrates other typical dilute o/w microemulsions according to this invention, which are especially suitable for spray-and-wipe types of applications and removals.

| | Percent | |
|---|---|---|
| | A | B |
| Sodium $C_{13-17}$ paraffin sulfonate | 4.0 | 4.0 |
| $C_{9-11}$ alcohol EO 5:1 | 3.0 | 4.0 |
| MgO | 0.25 | 0.25 |
| Diethylene glycol monobutyl ether | 3.75 | — |
| Ethylene glycol monobutyl ether | — | 3.75 |
| ****Perfume | 1.0 | 1.0 |
| $H_2SO_4$ or NaOH | to pH 6.8 | to pH 6.5 |
| Formalin | 0-0.2 | 0-0.2 |
| Antioxidant | 0-0.1 | 0-0.1 |
| Water | 87.7-88.0 | 86.7-87.0 |
| | 100.0 | 100.0 |

****Contains about 43% d-limonene, 10% grapefruit oil, 6% of other terpenes, and balance of esters, aldehydes and ethers The described formulas are excellent clear, stable microemulsion all-purpose cleaners and remove fatty soil (lard) from hard surfaces when applied as sprays and wiped off without rinsing, used as is, or diluted with an equal weight of water.

EXAMPLE 8

A composition of the formula of Example 7A is made, with the exception that the formulin and antioxidant ingredients are omitted. The cleaning properties of this composition are compared with an identical composition in which the 1% of perfume is replaced by 1% of water.

The cleaning performance comparison is based on a grease soil removal test. In such test, white Formica tiles (15 cm.×15 cm.) are sprayed with a chloroform solution containing 5% cooking fat, 5% hardened tallow and a sufficient amount of an oil soluble dye to render the film visible. After permitting the tiles to dry for about one-quarter of an hour at room temperature (24° C.), the tiles are mounted in a Gardner Washability Machine equipped with two cube-shaped cellulose sponges measuring five cm. on a side. 2.5 Grams of the liquid cleaning composition being tested are pipetted onto the sponge and the number of strokes required to remove the grease film is determined. Products are evaluated in pairs and usually six replications are run on each composition. The products are deemed to differ significantly in performance if the mean number of strokes for each product differs by more than five.

The results obtained are set forth in Table A below:

TABLE A

| Formulation | Mean Number of Strokes |
|---|---|
| Ex. 7-A | 25 |
| Ex. 7-A, without perfume | 48 |

The results in Table A clearly show that the presence of 1% by weight of the perfume in the invented microemulsion cleaning composition reduces the number of strokes required for cleaning by almost fifty percent, i.e., 48-25/48=23/48×100% or 48%. Such a result is truly surprising.

EXAMPLE 9

This example is presented to show that in the formulation of this invention the co-surfactant does not in itself contribute to grease removal performance. The cleaning performance test described in Example 8 is repeated, using the o/w microemulsion of Example 7-A and an identically prepared composition with the exception that the diethylene glycol monobutyl ether is replaced by an equal weight of water. The results obtained are set forth in Table B.

TABLE B

| Formulation | Mean Number of Strokes |
|---|---|
| Ex. 7-A | 25 |
| Ex. 7-A, without co-surfactant | 20 |

While the foregoing results clearly show that the co-surfactant does not contribute to grease removal performance, it should be noted that the composition without co-surfactant is of unsatisfactory appearance, being opaque. Furthermore, when the test is repeated using a perfume containing 2% terpenes in place of the perfume containing about 50% of terpenes, of Example 7-A, 25 strokes are required for cleaning for the composition of Example 7-A and for the composition without co-surfactant. In an additional variation of the experiment, using 1% by weight of a perfume containing 70% terpenes in the composition of Example 7-A, 25 strokes are required for said composition and 20 strokes are required for the composition without co-surfactant. Thus, the comparative experiments prove that the co-surfactant is not functioning as a grease removal solvent in the invented microemulsion cleaning compositions.

When an additional comparison is made between the composition of Example 7-A and an identical composition except that the diethylene glycol monobutyl ether (DEGMBE) co-surfactant is replaced by an equivalent weight of 1:1:1 mixture of succinic acid:glutaric acid:adipic acid, the following results are obtained.

| Formulation | Mean Number of Strokes |
|---|---|
| Ex. 7-A | 25 |
| Ex. 7-A, with acids mixture in place of DEGMBE | 25 |

The comparatives presented demonstrate that the grease removal capacity of the o/w microemulsions of this invention is based on the "dissolving power" of the microemulsion, per se, rather than on the presence or absence of grease removal solvent, or on any grease removing properties of the co-surfactants, because similar performance results are achieved with other perfumes containing essentially no terpenes, as well as with perfumes containing 60% and 70% by weight of terpenes, and the presence of co-surfactant does not in itself improve grease removal from treated substrates.

EXAMPLE 10

The ability of the inventive compositions to solubilize oleic acid soil is illustrated when the following compositions are compared, using the dissolving power test described in Example 1.

| | % by weight | | | |
|---|---|---|---|---|
| Component | 10A | 10B | 10C | 10D |
| Sodium $C_{13-17}$ paraffin sulfonate | 4.0 | 4.0 | 4.0 | 4.0 |
| $C_{9-11}$ alcohol EO 5:1 | 3.0 | 3.0 | 3.0 | 3.0 |
| Diethylene glycol monobutyl ether | 4.0 | 4.0 | — | — |
| Magnesium oxide | 0.25 | 0.25 | 0.25 | 0.25 |
| Sodium cumene sulfonate | — | — | 4.0 | 4.0 |
| Perfume (2% terpenes) | 1.0 | 0.4 | 1.0 | 0.4 |
| Water | 87.75 | 88.35 | 87.75 | 88.35 |
| | 100.00 | 100.00 | 100.00 | 100.00 |

The dissolving power of 100 grams of each of these compositions is set forth in Table C, below.

TABLE C

| Formulation | Gms. of Oleic Acid Solubilized |
|---|---|
| 10A | 6 |
| 10B | 7 |
| 10C | 1.2 |
| 10D | 1.2 |

In the foregoing comparisons, the dilute o/w microemulsion compositions, containing different proportions of perfume, solubilize five times more oleic acid than do "comparable" emulsion compositions containing cumene sulfonate hydrotrope in place of the DEGMBE co-surfactant.

In summary, the described invention broadly relates to an improvement in microemulsion compositions containing anionic detergent and/or nonionic detergent, a specified co-surfactant, a lipophilic component and water, which comprises the use of water insoluble perfume as the essential lipophilic ingredient or in place thereof, in a proportion sufficient to form either a dilute o/w microemulsion composition or a concentrated microemulsion composition which upon dilution with water can provide said dilute o/w microemulsion composition. The invented microemulsion compositions are clear and stable and are of superior cleaning characteristics for "spray and wipe" removal of greasy soils from hard surfaces. In acidic form such microemulsions are also clear and stable and are effective in removing lime scale and soap scum from bathroom fixtures, floors and walls.

From the foregoing working examples and the description of the invention given it is apparent that the perfume is desirably the only lipophile that may be considered to be active in contributing to the oil and grease removal by the invented compositions. The invented compositions preferably omit any other lipophilic materials that would otherwise be included in them for such solvent type of effect. Thus, the compositions may be considered to consist of the named detergent, perfume, co-surfactant and water (or various mixtures of such components) or to consist essentially of them.

The invented subject matter has been described with respect to various embodiments and working examples but it is not to be construed as limited to these because it is evident that one of skill in the art, with the present specification before him, will be able to utilize substitutes and equivalents without departing from the scope of the invention herein described.

What is claimed is:

1. A stable aqueous microemulsion cleaning composition in concentrated or dilute form, which, in the absence of opacifying component, is clear, and which is useful as an all-purpose cleaning composition, both the concentrated and diluted embodiments being especially effective to clean oily and greasy soils from substrates, which composition comprises anionic synthetic organic detergent and/or nonionic synthetic organic detergent, essentially water insoluble perfume, water and co-surfactant, which co-surfactant adjusts interfacial conformation to reduce interfacial tension between dispersed and continuous phases of said detergent(s), perfume and water of such microemulsion and thereby produces a stable microemulsion which, in the absence of opacifying component, is clear and stable at temperatures in the range of 5° to 50° C., and at a pH in the range of 1 to 11, and which composition does not contain any solvents for oils and greases other than the perfume.

2. A stable microemulsion cleaning composition according to claim 1, wherein the synthetic organic detergent component is a mixture of anionic and nonionic synthetic organic detergents and the co-surfactant is a water soluble lower alkanol of 2 to 4 carbon atoms, a polypropylene glycol of 2 to 18 propoxy units, a monoalkyl ether of a lower glycol of the formula $RO(X)_nH$ wherein R is a $C_{1-4}$ alkyl and X is $CH_2CH_2O$, $CH(CH_3)CH_2O$ or $CH_2CH_2CH_2O$, and n is from 1 to 4, a monoalkyl ester of the formula $R^1O(X)_nH$ wherein $R^1$ is a $C_{2-4}$ acyl and X and n are as immediately previously described, an aryl substituted lower alkanol of 1 to 6 carbon atoms, propylene carbonate, an aliphatic mono-, d i-, or tri-carboxylic acid of 3 to 6 carbon atoms, a mono-, di- or tri-hydroxy substituted aliphatic mono-, di-, or tri-carboxylic acid of 3 to 6 carbon atoms, a higher alkyl ether poly-lower alkoxy carboxylic acid of the formula $R^2O(X)_nYCOOH$, wherein $R^2$ is a $C_{9-15}$ alkyl, n is from 4 to 12, and Y is $CH_2$, $C(O)R^3$ or

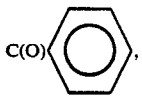

wherein $R^3$ is a $C_{1-3}$ alkylene, or a lower alkyl mono-, di-, or tri-ester of phosphoric acid, wherein the lower alkyl is of 1 to 4 carbon atoms, or any mixture thereof.

3. A microemulsion cleaning composition according to claim 2 wherein the proportions of synthetic organic detergents, perfume, water and co-surfactant are in the ranges of 5 to 65%, 2 to 50%, 15 to 85% and 2 to 50%, respectively.

4. A cleaning composition according to claim 3 wherein the synthetic organic detergent mixture is of an anionic detergent which is the higher linear alkylbenzene sulfonate or a higher paraffin sulfonate, or a mixture thereof, each of which is of 9 to 18 carbon atoms in the higher alkyl and paraffin moieties thereof, and wherein the nonionic detergent is a condensation product of higher fatty alcohol of 8 to 18 carbon atoms with 2 to 30 moles of ethylene oxide per mole of higher fatty alcohol.

5. A composition according to claim 4 wherein the perfume includes 1 to 35% of terpenes, on a product basis, and the co-surfactant is ethylene glycol monobutyl ether, diethylene glycol monobutyl ether, dipropylene glycol monobutyl ether, dipropylene glycol isobutyl ether, glutaric acid or a mixture of glutaric, adipic and succinic acids, or any mixture thereof, and in which the microemulsion is of dispersed phase particle sizes in the range of 50 to 1500 Å in diameter.

6. A composition according to claim 5 which, when anionic detergent is present in the composition, comprises 0.1 to 2.5 equivalents, in salt, oxide or hydroxide form, of a bivalent or multivalent metal cation per equivalent of said anionic detergent or in which at least 50% of said anionic detergent, on a molar basis, is a salt of a bivalent or multivalent metal, and wherein the pH is in the range of 2 to 7.

7. A composition according to claim 6 which comprises 0.5 to 10% of a $C_{8-22}$ fatty acid or fatty acid soap, and which is low-foaming.

8. A composition according to claim 1 wherein the proportions of synthetic organic detergent(s), perfume, water and co-surfactant are in the ranges of 5 to 65%, 2 to 50%, 15 to 85% and 2 to 50%, respectively.

9. A composition according to claim 3, of a pH in the range of 1 to 4, which is especially useful for removing lime scale and soap scum from bathtub and tile surfaces.

10. A composition according to claim 1 wherein the co-surfactant is dipropylene glycol monobutyl ether or dipropylene glycol isobutyl ether or a mixture thereof.

11. A composition according to claim 1 wherein the co-surfactant is a mixture of adipic acid, glutaric acid and succinic acid in proportions within the ranges of 1-3: 1-8:1-5, respectively, and the pH is in the range of 1 to 4.

12. A stable aqueous microemulsion cleaning composition which is of a formula corresponding to one part of a concentrated composition of claim 3, diluted with four parts of water.

13. A stable aqueous microemulsion cleaning composition which is of a formula corresponding to one part of a concentrated composition of claim 5 diluted with four parts of water.

14. A stable aqueous microemulsion cleaning composition which is of a formula corresponding to one part of a concentrated composition of claim 6 diluted with four parts of water.

15. A stable aqueous microemulsion cleaning composition which is of a formula corresponding to one part of a concentrated composition of claim 11 diluted with four parts of water.

16. A process for manufacturing a stable clear aqueous microemulsion cleaning composition which is in accordance with the description thereof in claim 1, which comprises dissolving the synthetic organic detergent in the water, admixing the co-surfactant with the aqueous detergent solution and subsequently admixing the perfume with the aqueous solution or emulsion of detergent, water and co-surfactant, at a temperature in the range of 5° to 50° C., which results in a clear and stable microemulsion cleaning composition which is of a pH in the range of 1 to 11 and in which the microemulsion is of dispersed phase particle sizes in the range of 50 to 1,500 Å in diameter.

17. A process for diluting the stable clear aqueous microemulsion cleaning composition of claim 1 to produce a diluted stable clear aqueous microemulsion cleaning composition of claim 6, which comprises adding four parts by weight of water at a temperature in the range of 5° to 50° C. to one part by weight of a composition of claim 1, which is at substantially the same temperature, while maintaining mixing of the composition during the addition of the water.

18. A process for removing oily soils from surfaces which comprises applying to such surfaces from which the oily soil is to be removed a composition of claim 1, whereby the oily soil is absorbed into the dispersed lipophilic phase of the composition, and removing such composition and the oily soil from such surface.

19. A process for removing oily soils from surfaces which comprises applying to such surfaces from which the oily soil is to be removed a composition of claim 12, whereby the oily soil is absorbed into the dispersed lipophilic phase of the composition, and removing such composition and the oily soil from such surface.

20. A process for removing lime scale and soap scum from bathtubs, sinks, bathroom tiles and other hard surfaces which comprises spraying onto such a surface a composition in accordance with claim 9 and removing such composition and the lime scale and/or soap scum from such a surface.

21. A process for removing lime scale and soap scum from bathtubs, sinks and bathroom tile and other hard surfaces which comprises spraying onto such surfaces a composition in accordance with claim 14 and removing such composition and the lime scale and/or soap scum from such surfaces.

* * * * *